United States Patent [19]

Daunheimer

[11] 4,029,831

[45] June 14, 1977

[54] METHOD OF MAKING A MULTI-GLOSS PANEL

[75] Inventor: Lyn A. Daunheimer, Batavia, Ill.

[73] Assignee: Masonite Corporation, Chicago, Ill.

[22] Filed: June 1, 1976

[21] Appl. No.: 691,703

Related U.S. Application Data

[63] Continuation-in-part of Ser. No. 588,322, June 19, 1975, abandoned, which is a continuation-in-part of Ser. No. 421,289, Dec. 3, 1973, abandoned.

[52] U.S. Cl. ..... 427/264; 427/56; 427/265; 427/271; 427/272; 427/302; 427/303; 427/374 R; 427/385 R; 427/393; 428/172

[51] Int. Cl.[2] ..... B05D 5/02; B05D 3/10

[58] Field of Search ..... 427/262, 267, 274, 280, 427/302, 303, 257, 264, 265, 266, 271, 272; 428/156, 172, 913

[56] References Cited

UNITED STATES PATENTS

| | | | |
|---|---|---|---|
| 2,082,050 | 6/1937 | Ernst | 427/277 X |
| 2,103,587 | 12/1937 | Lantz et al. | 117/10 |
| 2,651,871 | 9/1953 | Lynden | 117/38 |
| 2,681,867 | 6/1954 | Miller | 117/11 |
| 2,776,868 | 1/1957 | Russell et al. | 428/290 |
| 3,078,176 | 2/1963 | McBride | 427/264 X |
| 3,149,994 | 9/1964 | Congleton et al. | 117/45 |
| 3,154,427 | 10/1964 | Forrest et al. | 427/257 |
| 3,202,527 | 8/1965 | Stevens | 427/261 |
| 3,293,094 | 12/1966 | Nairn et al. | 117/10 X |
| 3,554,827 | 1/1971 | Yamagishi | 117/41 X |
| 3,607,380 | 9/1971 | Thams | 427/277 |
| 3,730,752 | 5/1973 | Garza et al. | 117/11 |
| 3,772,138 | 11/1973 | Witman | 428/159 |

*Primary Examiner*—Ronald H. Smith
*Assistant Examiner*—Evan K. Lawrence
*Attorney, Agent, or Firm*—Mason, Kolehmainen, Rathburn & Wyss

[57] ABSTRACT

A decorative panel having areas of different light reflecting characteristics is manufactured by inhibiting the curing of selected areas of a resinous top coat material which is applied to a panel substrate. In one technique a curing inhibitor is applied to selected areas of the substrate surface prior to application, over the entire surface, of a top coat material containing a mixture of an alkyd resin with melamine-formaldehyde, urea-formaldehyde or a mixture thereof. Upon curing, the inhibitor treated areas cure more slowly than the untreated areas and are characterized by a roughened, diffusely reflecting surface contrasting with the untreated areas having a smooth reflecting surface.

10 Claims, No Drawings

METHOD OF MAKING A MULTI-GLOSS PANEL

CROSS REFERENCE TO RELATED APPLICATIONS

This application is a continuation-in-part of co-pending application Ser. No. 588,322, filed June 19, 1975, now abandoned, which is a continuation-in-part of application Ser. No. 421,289 filed Dec. 3, 1973, now abandoned.

FIELD OF THE INVENTION

The present invention relates to a panel having surface areas of different gloss, and to a method of making the panel.

Most objects are visible because they reflect light. The most common type of reflection is called diffuse reflection in which light is reflected in all directions. Diffuse reflection occurs when the roughness of a reflecting body has dimensions large compared with the wavelength of the reflected wave. Another class of reflection is called regular or specular reflection in which, for example, a narrow beam or pencil of light is reflected in only one direction. Regular or specular reflection occurs from smooth surfaces whose irregularities are small compared with the wavelength of the reflected wave. For example, reflection from a blotter is diffuse, whereas reflection from a mirror is specular. As applied to decorative panels and the like, the term high gloss describes surfaces characterized by specular or regular reflection, and the term low gloss describes surfaces characterized by diffuse reflection.

BACKGROUND OF THE INVENTION

Decorative panels such as hardboard paneling and hardboard tiles are often provided with a top coat comprising one or more applications of a resin such as a polyester, a phenolformaldehyde, an alkyd resin, or the like, cured to form a smooth, scratch resistant surface. It is conventional to decorate the surface of a coated panel to enhance its aesthetic value so that the panel can be used, for example, as a floor, wall or ceiling covering. The surface of known decorated panels reflect light substantially uniformly over their entire surfaces, and the reflection typically is either specular or slightly diffuse.

Decorative panel surfaces have been heretofore formed in a variety of ways. A common method of decorating a panel surface is by mechanical or chemical embossing. Mechanical embossing is accomplished by compressing the surface of the panel to form raised and lowered surface areas in a desired pattern such as, for example, a wood grain pattern. Usually this is accomplished under the action of both pressure and heat.

PRIOR ART

More recently there has been developed a method of chemical embossing of a surface in which the surface is coated with a resin containing a blowing agent. An ink containing a chemical agent which retards the effect of the blowing agent is applied over the resinous coating in a desired pattern. Another resinous layer may then be applied and the coated material heated to activate the blowing agent in the resin except in the areas underlying the inked pattern. In this manner, the blowing agent causes the resinous coating to rise to a thickness greater than the thickness of the resin underlying the inked pattern. Examples of chemical embossing can be found in U.S. Pat. Nos. 3,365,353 and 3,373,072, 3,574,659 and 3,660,187.

Another method of chemical embossing is found in U.S. Pat. No. 3,554,827-Yamagishi. The process of Yamagishi is similar to those disclosed in the previously cited patents except that Yamagishi uses an ink containing a curing inhibitor instead of an ink containing a blowing agent suppressor. As a result of the differences in curing rate of the coating applied over the inhibitor-containing ink, when the resin begins to cure above those areas which have not been printed with the curing inhibitor, the resin overlying the pattern of curing inhibitor is sucked or drawn away from above the inhibitor treated areas and toward the resin which is curing. The final cured product has a series of grooves and ridges corresponding to the inked pattern of curing inhibitor. Thus, these chemical embossing processes cause a substantial variation in elevations on the surface of the rigid material. The surface level variations are substantial and an be detected by touch and/or visual inspection.

Another prior art method of decorating the surface of a decorative panel is shown in U.S. Pat. No. 3,159,525-Finger. In the Finger method, the panel substrate is coated with a resinous layer. A film such as a cellulose acetate film is applied over the resin prior to curing. When the resin is cured, the film crinkles because of the shrinkage of the resin. The film is then stripped from the resinous surface to leave a surface having a decorative crinkled effect.

An important object of the present invention is to provide a panel having areas of different light reflecting properties, for example, areas of high gloss and areas of low gloss. Other objects of the invention are to provide a panel in which the reflection of light from the surface of the panel masks defects such as flaws, crevasses, protrusions, or scratches in the panel surface; to provide a method for manufacturing a panel having areas of differing gloss; and to provide a method for manufacturing decorative panels characterized by simplicity, low cost and uniformity in result.

SUMMARY OF THE INVENTION

In brief, in accordance with the present invention there is provided a panel having a surface which is substantially flat and planar both in appearance and to the touch. Some areas of the surface of the panel are relatively smooth and form areas of high gloss characterized by specular reflection. Other areas are microscopically roughened to a degree which is not detectable by the naked eye but which produces diffuse reflection of light and consequently a low gloss surface. The combination on a flat panel surface of areas of differing gloss provides an extremely pleasing and attractive appearance and creates an aesthetically desirable contrasting and highlighting effect. The panel surface of the present invention also effectively masks defects and deformities formed in the surface coating.

In accordance with the method of the present invention, a decorative panel having areas of differing gloss is made by applying to the surface of a panel substrate an uncured resinous top coat material. The material is cured, and the curing of the top coat is inhibited in selected areas of the surface. The resulting panel has a surface which is substantially flat and, in the selected areas, is microscopically roughened.

DETAILED DESCRIPTION OF THE PREFERRED EMBODIMENTS

Proceeding now to a more detailed description of the present invention, a panel in accordance with the invention may include a substrate of any desired character. Although a water-laid or air-laid cellulosic sheet or board material is preferable, materials such as plywood, particle board, natural wood, thermosetting resin, cardboard and others may be used.

When a wood surface such as natural wood or a water-laid or air-laid fiber product is used as the substrate, it is preferred to smooth out the surface of the substrate as by coating the substrate with a filler or sizing agent to fill in the voids between wood fibers. There are many well known compositions of fillers and sizing agents which can be used to fill the fiber-to-fiber voids in a wood fiber material. For example, U.S. Pat. No. 3,554,827 previously referred to discloses one particular filler composition which is suitable in practicing the present invention. It is not essential to begin with a smooth surfaced substrate, but in applying a desired decorative pattern to the substrate it is easier to accentuate an applied pattern if there is no visual interference from uncontrollable contours and/or flaws which may be present in a rough material.

Thermosetting resinous sheets generally have smooth surfaces and therefore require no smoothing pretreatment in order to achieve best highlighting effects in accordance with the present invention. Further, the resinous sheet may be fabricated in a desired color and a ground coat may not be necessary. A paper sheet easily can be sized or filled either during or after manufacture. Of course, a smooth surface can also be provided by applying to the base material an additional thin layer of paper, cloth, film or the like in lieu of a layer of filler or sizing material.

The surface of the panel substrate can first be coated with a resinous ground coat. The only necessary property of the ground coat, when used, is that after curing it must be resistant to softening by a solution containing a top coat curing inhibitor because a curing inhibitor is applied over the ground coat. The ground coat serves the purpose of providing background color to the finished product. The ground coat can have an inherent color after curing, or pigments such as $TiO_2$, and the like can be mixed with the ground coat prior to curing. Preferred ground coat materials are acrylic resin coatings and any aqueous resin coatings so long as the resin vehicle is resistant to softening by a top coat curing inhibitor. Included are water soluble, water dispersible and water reducible coatings. Some of these coatings are set forth in the text *Emulsion and Water-Soluble Paints and Coatings* 1964, by Charles R. Martens at pages 15–34 and particularly at pages 32 and 33.

Some examples of the many types of resin vehicles suitable as ground coats which are neither softened by the particular top coat curing inhibitors used nor by the solvents used to carry the curing inhibitor, are as follows: vinyl resins such as polyvinyl chloride, polyvinyl acetate, copolymers of vinyl chloride and vinyl acetate, vinylidene-chloride resins, copolymers of vinylidene-chloride and polyvinyl chloride; an acetate such as polyvinyl acetal; urea-formaldehyde and melamine-formaldehyde resins; polystyrene polyamides; polyurethanes; acrylic resins such as polymers of acrylic or methacrylic acid, acrylonitrile, polymerized esters of acrylic acid and methacrylic acid, polymerized methyl methacrylate, and copolymers of these acrylic monomers. Substantially, all of the acrylic and water soluble resins will not be softened by a top coat curing inhibitor. Many other ground coats can also be used. The ground coat provides a background color to the product.

After application to the substrate, the ground coat is cured. Any suitable curing means such as heat, radioactive rays, or other means may be used to provide a polymerizing environment for the particular ground coat. Curing catalysts can be incorporated into the ground coat for faster curing, for example in an amount of about 1–5 percent.

In accordance with the invention, the top coat applied to the panel is cured at different rates in different areas to provide surface regions of different gloss. This may be accomplished by applying a top coat curing inhibitor solution to the above prepared substrate in selected areas to form a desired pattern. It is preferred to apply the top coat curing inhibitor pattern in the form of a liquid ink solution containing solvents. As a result, the pattern of gloss on the finished panel corresponds to a printed pattern on the panel. Many other means can be employed to inhibit the cure of the top-coating material in a desired pattern as will be described in more detail hereinafter.

The weight percentage of top coat curing inhibitor contained in the ink should be in the range of about 1 to 50 percent. It is preferred to use about 7 to 30% by weight curing inhibitor. At levels below 1% curing inhibitor the difference in gloss caused by the application of the curing inhibitor prior to curing the top coat is not sufficiently noticeable and therefore does not provide the new and unexpected multiple reflection characteristics of applicant's product. Any amount of curing inhibitor greater than 50% by weight of the ink represents a point of diminishing return in terms of difference in gloss on the surface of applicant's product. It is, therefore, preferred that no more than 50% curing inhibitor be included within the ink.

The pattern of curing inhibitor, and ink if desired, can be applied to selected areas of the surface of the cured ground coat in a variety of ways known in the art and the method of application is not critical. For example, the inhibitor may be applied by a stencilling operation, a printing operation, or otherwise.

After the curing inhibitor solution has been applied to selected areas, it is preferred to flash off a substantial portion of the solvents which may be present in the solution. The substrate may be heated to a temperature above the vaporization temperature of the solvents to flash off a substantial portion of these solvents. It is preferred to drive off substantially all of the solvents contained in the curing inhibitor solution so that the pattern or design is left substantially dry on the cured ground coat. This prevents spread of the curing inhibitor out of the selected areas of application so that the desired pattern remains clear and well defined when the top coat is applied.

After flashing off the curing inhibitor solvents, a resinous top coat is applied. It is preferred to apply the top coat in a thickness of about 1 millimeter. In the areas overlying the curing inhibitor, the curing of the top coat is inhibited or suppressed so that curing takes place at a different, slow rate as compared with the curing rate in untreated areas. The top coat should remain substantially flat after curing in order to take full advantage of applicant's multiple gloss surface highlighting. If the surface of the substrate were indented after curing, one of the major advantages of applicant's flat surfaced product would be lost. That advantage is the apparent disappearance of any flaws or scratches in the surface of applicant's product as a result of the optical effect of the patterned, multiple gloss, flat surface of applicant's product. The top coat should therefore not be pulled away or thinned out in portions defining the pattern of curing inhibitor. This is in contrast to the disclosure of the Yamagishi U.S. Pat. No. 3,554,827 where it is taught that a curing inhibitor for a top coat of a polyester resin causes portions of the layer that overlie the retarding agent to be thinned out to thereby cause an indented pattern in the surface of the decorative panel. Applicant's top coat and top coat curing inhibitor does not interact in this manner to cause an indented pattern.

It has been found that a top coat comprising a combination of an alkyd resin and melamine-formaldehyde, urea-formaldehyde or a mixture of melamine-formaldehyde and urea-formaldehyde does not thin out or form indentations when selected portions of these top coats are inhibited from curing. The term "alkyd" resin specifies a polyester product comprising one or more polyhydric alcohols, polybasic acids, and monobasic fatty acids. The resin is generally combined with hydrocarbon solvents comprising 30–70% by weight of the alkyd resin.

Two of the best polyhydric alcohols useful in the preparation of alkyd resins are pentaerythritol and glycerol. Also, pentaerythritol is often blended with either glycerols or glycols in the preparation of alkyd resins. Some of the other preferred polyhydric alcohols useful in the preparation of alkyd resins are the following: dipentaerythritol, trimethylolethane [2-(hydroxymethyl)-2-methyl-1,3-propanediol], sorbitol, trimethylolpropane (2-ethyl-2-(hydroxymethyl)-1,3-propanediol), ethylene glycol, diethylene glycol, propylene glycol, neopentylene glycol (2,2-dimethyl-1,3-propanediol), and dipropylene glycol.

Some of the preferred polybasic acids useful in the reaction with the above polyhydric alcohols in forming alkyd resins are the following: phthalic anhydride, isophthalic acid, maleic anhydride, fumaric acid, azelaic acid, succinic acid, adipic acid, and sebacic acid. The polybasic acids are generally combined with the polyhydric alcohols in approximately equimolar quantities and generally within the range of 0.8 – 1.2 moles of polyhydric alcohol per mole of polybasic acid.

The monobasic fatty acids used in the reaction with the polyhydric alcohols and the polybasic acids are obtained from any fatty acid source including an oil such as soya, linseed, dehydrated castor oil and tall oil. The fatty acids generally comprise 20–70 percent by weight of the alkyd resin, preferably 25–50 percent. The remainder is the reaction product of the polyhydric alcohols and polybasic acids. Some of the most common monobasic fatty acids are the following: fatty acids and fractionated fatty acids obtained from oils, tall oil fatty acids, synthetic saturated fatty acids such as pelargonic, isodecanoic, isooctanoic, and 2-ethylhexanoic. Other useful oil modified and resin modified alkyds are well known and fully set forth in the *Handbook of Plastics*, Simonds, Weith and Bigelow, 2nd Edition, 1949, at pages 666–671. The entire charge of fatty acids, polyhydric alcohols, and monobasic acids is heated to reaction temperature of about 210°–280° C. and maintained until the reaction is completed. The reactions to produce alkyd resins are well known as set forth in the *Encyclopedia of Chemical Technology*, Kirk-Othmer, 2nd Edition, 1967, at pages 851–881. The polyhydric alcohol may also be first reacted with the dibasic acid before the addition of the fatty acids. With oil-modified alkyds, the oil can be added directly to the other components prior to reaction. It is preferred to add the alkyd resin with the urea-formaldehyde and/or melamine-formaldehyde resin in approximately equal proportions and generally within the range of 30–70% alkyd by weight and the remaining 30–70% urea-formaldehyde and/or melamine-formaldehyde. Although film formation and the desirable physical properties of the cured top coat material are not as good near the end points of the range, the urea-formaldehyde and/or melamine-formaldehyde can be present in the resinous top coat in an amount of 5–95% by weight of the total solids in the top coating with the remaining 5–95% comprising the alkyd resin, corresponding to a weight ratio range of the alkyd resin to the formaldehyde resin of 1:19 to 19:1. The combination of resins is generally provided in a hydrocarbon solvent such as mineral spirits in an amount of about 25–75% solvent based on the total weight of the top coat material. If desired, curing catalysts, such as p-toluene sulfonic acid, can be added to speed the cure of the top coat, and may be particularly desirable in top coats containing urea-formaldehyde. A curing catalyst is not essential, but when used, it is preferred to include the curing catalyst in an amount of about 3% by volume of top coat resin solids including alkyd and urea-formaldehyde and/or melamine-formaldehyde resins. All such top coating combinations of alkyd resins with urea-formaldehyde and/or melamine-formaldehyde resins will cure to a substantially flat surface having a patterned multi-gloss surface when selected areas of the top coat are inhibited from curing.

Any means can be used to inhibit the cure of selected areas of the alkyd resin – urea-formaldehyde resin or alkyd resin – melamine-formaldehyde resin topcoat. The preferred method of inhibiting the cure of the top coat material in selected areas is by contacting the uncured top coat in selected areas with a pattern of curing inhibitor. The pattern of inhibited top coat material reflects light more diffusely on the finished panel and sharply contrasts to the specular light reflection of the uninhibited areas.

Another illustrative method of inhibiting the cure of selected areas of the top coat material is by cutting out a metal plate in a desired design to form a stencil and disposing the stencil over a top-coated panel. The top surface of the stencil is then exposed to infra-red light (IR) so that the top coat portion directly below the cut out areas of the stencil are cured with IR and the remainder of the top coat is cured with radiant heat. The top coat material directly below the stenciled pattern will cure at a different rate than the remainder of the top coat material, resulting in the desired multi-gloss effect. As another method, an IR absorber can be printed over the top surface of the top coat material and then used to cure the top coat. In this manner, the top coat directly under the pattern of IR absorber will cure more slowly than the remainder of the top coat material, causing the desired multi-gloss effect.

Another method of curing selected areas of the top coat at a different rate is by disposing a metal plate on the back surface of a top-coated panel and circulating cooling fluid in a desired pattern in heat exchange relation to the plate. Convection heat used to cure the top coat will cure the top coat over the flowing cooling fluid more slowly than the remainder of the top coat material, resulting in the desired multi-gloss effect as described herein.

Another illustrative method for inhibiting selected areas of the top coat material is to print an IR absorber, in a desired pattern, onto a transparent or translucent sheet, such as glass. The printed plate is then disposed above the top-coat material and the plate is exposed to IR. The IR absorber will inhibit the cure of the top-coating material directly under the pattern of absorber to provide the desired multi-gloss effect. It should be understood that many other means can be employed to inhibit the cure of the top-coating material in a desired pattern similar to those methods herein described.

Three curing inhibitors have been found to function especially well in affecting the curing rate of the above top coats without causing an indented surface pattern. These curing inhibitors are an amino methyl-propanol (AMP), hydroxyethyl-trimethyl ammonium bicarbonate, and choline. However, other curing inhibitors may be used so long as the top coat is caused to cure at a different rate in the portions which overlie the inhibiting agent while maintaining a substantially flat surface.

In accordance with an important feature of the invention, the difference in curing rate causes a microscopically roughened surface in a desired pattern. The term "microscopically roughened" connotes a surface which is not visibly indented but appears to be rough rather than smooth when viewed through a microscope.

Other top coats can be used in conjunction with other curing inhibitors so long as the inhibitor causes a change in gloss in the portions of the top coat which overlie the inhibiting agent and so long as the top coat surface remains substantially flat and is not thinned out above the curing inhibitor.

EXAMPLES

EXAMPLE 1

A smooth surface hardboard tile having flaws and scratches is first coated with polyacrylic acid resin (60% solids 40% xylol-naphtha solvent) ground coat and the ground coat solvents are flashed off at 250° F for about 60 seconds. A curing inhibitor solution containing 70% butyl cellulose type ink and 30% hydroxyethyl trimethyl ammonium bicarbonate top coat curing inhibitor is then applied over the ground coat in a pattern. The solvents from the ink are then flashed off at about 250° F until the ink is substantially dry.

Thereafter, a top coat of 49.95% alkyd resin, 50.0% melamine-formaldehyde resin and 0.05% inert Silica pigment (percents based on total solids in top coat) containing 40% mineral spirits solvent is applied over the pattern of curing inhibitor in a thickness of 1 millimeter. The alkyd has equimolar proportions of maleic anhydride and ethylene glycol and contains 50% by weight linseed oil fatty acids. The top coat is then heated at about 350° F for about 15 minutes to cure the coating.

The resulting product reflects light in a pattern of diffuse reflection corresponding to the pattern of curing inhibitor solution. The flaws and scratches initially present in the hardboard tile are masked by the patterned reflection.

EXAMPLE 2

A laminated paper sheet is coated with a catalyzed vinyl ground coat — a copolymer of vinyl chloride and vinyl acetate, catalyzed with about 1% para-toluene sulfonic acid.

The coated sheet is heated at 350° F for about 20 seconds to drive off the ground coat solvents and to cure the ground coat. A top coat curing inhibitor ink solution of acetyl cellulose type ink containing 15% amino methyl propanol curing inhibitor is applied over the ground coat in a desired pattern. The solvents from the ink solution are then flashed off in about 40 seconds at about 250° F.

A top coat of 45.76% alkyd resin, 47.37% urea-formaldehyde resin and 6.8% inert Silica pigment, where percents are percent by weight of total solids in the top coating, and containing about 40% by total weight of top coat material of laquer solvents is applied in a thickness of about 1 millimeter. The alkyd is formed by the reaction of equimolar quantities of phthalic anhydride and pentaerythritol and 30% by weight tall oil fatty acids. A p-toluene sulfonic acid curing catalyst in an amount of 3% by volume of alkyd plus urea-formaldehyde is added to the top coat to speed the cure.

The top coat is then heated for about 60 seconds at 250° F to drive off top coat solvents and then cured with infrared light for about one minute. The product reflects light in a pattern of diffuse reflection corresponding to the pattern of curing inhibitor solution applied for a most unexpected and pleasing appearance.

EXAMPLE 3

An ABS (acrylonitrite-butadiene-styrene) resinous sheet is coated in a desired pattern with a solution of a curing inhibitor ink solution containing 25% choline, and 75% butyl cellulose type ink. The ink solvents are flashed off for about 60 seconds at 250° F. A top coat of 65.55% alkyd resin, 16.50% urea-formaldehyde resin, 16.50% melamine-formaldehyde resin, and 1.45% Silica inert pigment (percents based on total solids in top coat) containing 25% by weight mineral spirits solvent is applied in a thickness of about 1 millimeter. The alkyd resin has equimolar quantities of isophthalic acid and propylene glycol and contains 60% isodecanoic acid. A p-toluene sulfonic acid curing catalyst in an amount of about 3% by volume of (alkyd resin plus urea-formaldehyde resin plus melamine-formaldehyde resin) is added to the top coat to speed curing. The top coat is cured at about 250° F for about 2 minutes until the top coat is hard. The resinous sheet reflects light in a pattern of diffuse reflection while masking any defects originally on the resinous sheet.

Although the present invention has been described with reference to details of the disclosed embodiments, such details should not be taken to limit the invention as defined in the following claims.

What is claimed and desired to be secured by Letters Patent of the United States is:

1. A method of making a panel having a substantially flat planar surface with areas of differing light reflection characteristics, comprising the steps of:

applying to substantially the entire surface of a panel substrate a uniform thickness of a curable resinous top coat material comprising an alkyd resin and a second resin selected from the group consisting of urea-formaldehyde, melamine-formaldehyde and a mixture of urea-formaldehyde and melamine-formaldehyde wherein the ratio of alkyd resin to the second resin is in the weight ratio range of 1:19 to 19:1.

Curing said top coat material over substantially the entire surface thereof; and inhibiting the curing of said top coat material in portions overlying selected areas of said surface to cause said portions to cure at a lower rate than the remainder of the coating thereby obtaining a cured substantially flat and planar top coat surface which reflects light more diffusely in a desired microscopically roughened pattern corresponding to the inhibited portions of said top coat material.

2. The method of claim 1 wherein said inhibiting step is carried out by applying a curing inhibitor to said selected areas prior to applying said top coat material.

3. The method of claim 2 wherein said curing step comprises heating.

4. The method of claim 3 wherein said curing inhibitor is applied to said substrate surface in said selected areas prior to applying said top coat material.

5. The method of claim 4, further comprising applying said curing inhibitor in said selected areas by printing a coating containing inhibitor on said substrate surface.

6. A method of making a substantially flat panel having more than one gloss for reflecting light in a desired pattern, which comprises:

applying to a panel substrate, in a desired pattern, a a solution containing a curing inhibitor for a subsequently applied resinous top coat, coating substantially the entire surface of the patterned substrate with a uniform thickness of a curable resinous top coat material comprising an alkyd resin and a second resin selected from the group consisting of urea-formaldehyde, melamine-formaldehyde and a mixture of urea-formaldehyde and melamine-formaldehyde wherein the ratio of alkyd resin to the second resin is in the weight ratio range of 1:19 to 19:1;

heating the coated substrate to cure the top coat over substantially the entire surface thereof such that the top coat overlying the pattern of curing inhibitor cures at a lower rate than the top coat not overlying the pattern of curing inhibitor to provide a top coat with a substantially flat and planar surface having a microscopically roughened pattern thereon causing light to be reflected more diffusely from said pattern corresponding to the pattern of curing inhibitor applied.

7. A method as defined by claim 6 further comprising:

coating said surface with a resinous ground coat prior to applying said curing inhibitor wherein said ground coat is not substantially softened by said solution of the top coat curing inhibitor.

8. A method as defined by claim 7 wherein the solution containing a top coat curing inhibitor contains about 7 to 30% by weight of said inhibitor.

9. A method as defined by claim 8 wherein the top coat curing inhibitor is selected from the group consisting of an amino methyl propanol, a hydroxyethyltrimethyl ammonium bicarbonate, and choline.

10. A method as defined by claim 7 wherein the curing inhibitor comprises 15% by weight of said solution.

* * * * *